US006942543B2

(12) United States Patent
Kobayashi et al.

(10) Patent No.: US 6,942,543 B2
(45) Date of Patent: Sep. 13, 2005

(54) SUBSTRATE POLISHING APPARATUS

(75) Inventors: Yoichi Kobayashi, Kanagawa (JP); Shunsuke Nakai, Tokyo (JP); Hitoshi Tsuji, Tokyo (JP); Yasuo Tsukuda, Osaka (JP); Hiroki Yamauchi, Shiga (JP)

(73) Assignees: Ebara Corporation, Tokyo (JP); Shimadzu Corporation, Kyoto (JP)

( * ) Notice: Subject to any disclaimer, the term of this patent is extended or adjusted under 35 U.S.C. 154(b) by 0 days.

(21) Appl. No.: 10/854,250

(22) Filed: May 27, 2004

(65) Prior Publication Data

US 2004/0219865 A1 Nov. 4, 2004

Related U.S. Application Data

(62) Division of application No. 10/329,424, filed on Dec. 27, 2002, now Pat. No. 6,758,723.

(30) Foreign Application Priority Data

Dec. 28, 2001 (JP) ..... 2001/400520

(51) Int. Cl.[7] ..... B24B 1/00

(52) U.S. Cl. ..... 451/6; 451/10; 451/11; 451/285; 156/345.13

(58) Field of Search ..... 451/6, 8, 9, 10, 451/11, 41, 285, 287, 288, 54; 156/345.13

(56) References Cited

U.S. PATENT DOCUMENTS

| | | | |
|---|---|---|---|
| 5,609,511 | A | 3/1997 | Moriyama et al. |
| 5,657,123 | A | 8/1997 | Mogi et al. |
| 5,708,506 | A | 1/1998 | Birang |
| 6,106,662 | A | 8/2000 | Bibby, Jr. et al. |
| 6,111,634 | A | 8/2000 | Pecen et al. |
| 6,280,290 | B1 | 8/2001 | Birang et al. |
| 6,599,765 | B1 | 7/2003 | Boyd et al. |
| 6,609,947 | B1 | 8/2003 | Moore |
| 6,628,397 | B1 | 9/2003 | Nikoonahad et al. |
| 6,657,737 | B2 | 12/2003 | Kimba et al. |
| 6,671,051 | B1 | 12/2003 | Nikoonahad et al. |

FOREIGN PATENT DOCUMENTS

| | | |
|---|---|---|
| JP | 2000-254860 | 9/2000 |
| JP | 2001-88021 | 4/2001 |
| JP | 2001-235311 | 8/2001 |
| WO | 01/20304 | 3/2001 |

*Primary Examiner*—Eileen P. Morgan
(74) *Attorney, Agent, or Firm*—Wenderoth, Lind & Ponack, L.L.P.

(57) ABSTRACT

The substrate polishing apparatus for polishing a polishing surface of a substrate comprises a film thickness monitoring device for monitoring a state of a film thickness of a thin film on the polishing surface of the substrate during polishing. The apparatus includes a table, a polishing member fixed on a surface of the table, a substrate support member for pressing the substrate onto the polishing member, an optical system composed of an optical fiber for irradiating the polishing surface of the substrate with a light of irradiation and an optical fiber for receiving a reflected light reflected on the polishing surface of the substrate, an analysis-processing system for processing an analysis of the reflected light received with the optical system, and the film-thickness monitoring device. The table is provided with a liquid-feeding opening for feeding a translucent liquid into a through-hole disposed in the polishing member.

10 Claims, 15 Drawing Sheets

(a)

(b)

(a)

(b)

SUBSTRATE POLISHING APPARATUS

This is a Divisional Application of U.S. patent application Ser. No. 10/329,424, filed Dec. 27, 2002, now U.S. Pat. No. 6,758,723, issued Jul. 6, 2004.

BACKGROUND OF THE INVENTION

The present invention relates to a substrate polishing apparatus for polishing a substrate to be polished, including a semiconductor wafer and so on. More particularly, the present invention relates to a substrate polishing apparatus having a film thickness monitor device for continuously monitoring a state of a film thickness of a thin film on a surface to be polished of the substrate (including but not being limited to the state of the film thickness and a state of the film thickness remaining on the surface) in real time during polishing with the substrate polishing apparatus.

Conventional techniques for monitoring a film thickness of a thin film on a substrate for use with a substrate polishing apparatus include, for example, a film thickness monitor device for monitoring a film thickness of the thin film on a substrate, as disclosed in JP-A-2001-235311 (Japanese Patent Public Disclosure). This apparatus is configured to monitor a film thickness of a thin film on the surface of a substrate on the basis of an intensity of reflected light. Water flows in a columnar form along the surface of the substrate to be polished, and the surface thereof is irradiated with an irradiation light, and the irradiated light is reflected from the surface through the flow of water to be received by an optical fiber.

One aspect of a conventional substrate polishing apparatus is constructed as decribed above. However, a problem exists with such an apparatus in that water flowing in columnar form over a surface to be polished is not stable at a contact point with the surface and tends to vary, thus making it difficult to reliably and accurately monitor a film thickness of a thin film on the surface of the substrate film using reflected irradiated light.

As a similar technique, there is proposed a polishing-end-point detection mechanism as disclosed in JP-A-2001-88021. This mechanism is composed of an optical fiber mounted in a depression in the surface of the table so as to face a light-irradiating and light-receiving surface at one end thereof, and a flow path for feeding a washing liquid, the path having one end opening in the depression. By this configuration, while the washing liquid is being fed into the depression through the flow path, the surface to be polished of a wafer is irradiated with light through the washing liquid in the depression from the optical fiber, and the light reflected on the surface is received through the washing liquid and the optical fiber in the depression. The polishing-end-point is then detected on the basis of surface information about the surface of the substrate obtained from the reflected light.

However, a problem also exists in this art in that a washing liquid may flow in the depression in an irregular way when fed through the flow path. This is a particular problem when the washing liquid is fed through a porous member. In such a case, polishing grains contained in a polishing liquid, polished chips of the wafer, polished chips of a polishing pad, and so on enter the depression, and obstruct transmission and reception of irradiated light. Thus, information about the surface of the substrate cannot be obtained with high accuracy.

SUMMARY OF THE INVENTION

It is an object of the present invention to overcome the stated problems of the conventional arts, and to provide a substrate polishing apparatus with a film-thickness monitoring device capable of monitoring a state of a film thickness of a thin film on a surface of a substrate to be polished with high accuracy and reliability during a polishing operation.

To achieve the stated object, the present invention in a first aspect provides a substrate polishing apparatus for polishing a substrate to be polished by means of a relative movement between the substrate and a polishing member, which comprises a table, the polishing member being fixed on top of the table. A substrate support member presses the substrate to be polished onto the polishing member. An optical system is composed of an optical fiber for irradiating the surface of the substrate with a light through a through-hole disposed in the polishing member, and an optical fiber for receiving the reflected light reflected from the irradiated light on the surface through the through-hole.

The substrate polishing apparatus further comprises an analysis system for analyzing the reflected light received by the optical system and a film-thickness monitoring device for monitoring a film thickness of a thin film formed on the surface of the substrate and a state of progress of polishing the thin film on the surface thereof on the basis of an analysis of the reflected light by means of the analysis system. The table is provided with a liquid-feeding opening for feeding a translucent liquid to the through-hole disposed in the polishing member. The liquid-feeding opening is disposed so that the translucent liquid fed to the through-hole through the liquid-feeding opening flows in a direction roughly perpendicular to the surface of the substrate, i.e., to form a perpendicular flow which fills the through-hole, with the optical fiber being disposed such that the irradiated light and the reflected light pass through a flow portion of the translucent liquid flowing in the direction generally perpendicular to the surface.

Thus, in the configuration of the substrate polishing apparatus in the first aspect of the invention, the surface of the substrate is irradiated with light through a flow portion of the translucent liquid flowing in the direction generally perpendicular to the surface, and the irradiated light reflected from the surface is received through the perpendicular flow of the translucent liquid. Accordingly, particles of foreign materials, including polishing grains contained in the polishing liquid, polished chips of the polishing member or the substrate, etc., cannot enter the perpendicular flow portion of the translucent liquid from a gap between the polishing member and the surface so that the film thickness of the thin film on the substrate can be observed with high accuracy and stability without intervention from those particles.

It is to be noted herein that the translucent liquid to be fed through the liquid-feeding opening may include, but is not limited to, a transparent liquid having a high transparency which is highly transparent immediately after the supply into the through-hole but may become turbid while flowing due to contamination with a polishing liquid. Therefore, the translucent liquid as referred to herein may include, but is not limited to, any transparent or translucent liquid ranging from a transparent liquid having a high degree of transparency to a translucent liquid having a low degree of transparency.

In a second aspect of the invention, the substrate polishing apparatus in the first aspect of the invention is further constructed such that the through-hole has a section extending in a direction perpendicular to a flow of the translucent liquid that is equal in size to the liquid-feeding opening and in fluid communication therewith.

As the through-hole and the liquid-feeding opening have equal sections extending in the direction perpendicular to the liquid flow and are communicated with each other, the translucent liquid fed from the liquid-feeding opening into the through-hole flows in the direction perpendicular to the surface of the substrate to be polished up to the surface. Therefore, even in a small amount, the flow of the translucent liquid is able to serve as a suitable optical path for passage of the irradiated light and the reflected light.

The substrate polishing apparatus in a third aspect of the invention is characterized in that the substrate polishing apparatus in the first or second aspect of the invention is further provided with a liquid-discharging groove on the surface of the polishing member, the liquid-discharging groove being for discharging the translucent liquid rearward from the inner side face of the through-hole in the direction of movement of the table.

As the liquid-discharging groove is provided on the upper surface of the polishing member for discharge of the translucent liquid from the inner side faces of the through-hole rearward, and in the direction of movement of the table, the translucent liquid filled in the closed space of the through-hole can be withdrawn readily from the inner side face of the through-hole without the need for any special system.

The substrate polishing apparatus in a fourth aspect of the invention is constructed such that the substrate polishing apparatus in the first aspect of the invention is further provided with a liquid-discharging opening for discharging the translucent liquid in the through-hole, which is located behind the liquid-feeding opening in the direction of movement of the table and has an opening at the side face of the through-hole opposite to the substrate to be polished.

As the substrate polishing apparatus in the fourth aspect of the invention has the liquid-discharging opening behind the liquid-feeding opening in the direction of movement of the table and has an opening at the side of the through-hole opposite the substrate, in the manner as described above, the translucent liquid within the through-hole can be withdrawn into a gap between the substrate and the polishing member without diluting the polishing liquid present therein. Further, the provision of the liquid-discharging opening behind the liquid-feeding opening in the direction of movement of the table enables a flow to form of the translucent liquid fed from the liquid-feeding opening into the through-hole, that is, it allows the translucent liquid to flow in the direction perpendicular to the surface of the substrate, in a manner as will be described hereinafter in more detail.

In a fifth aspect of the invention, the substrate polishing apparatus is characterized in that the substrate polishing apparatus in the fourth aspect of the invention is further arranged such that the middle point of a line segment connecting the center of the liquid-feeding opening and the center of the liquid-discharging opening is located before the central point of the through-hole in the direction of movement of the table.

As a result, the translucent liquid fed from the liquid-feeding opening into the through-hole is able to form a flow perpendicular to the surface of the substrate in a manner as will be described hereinafter in more detail.

The substrate polishing apparatus in a sixth aspect of the invention is constructed such that the substrate polishing apparatus in the fourth or fifth aspect of the invention is further provided with the through-hole in a generally elliptic section in such a manner that a circumference of the external end thereof is disposed so as to enclose the end faces of the liquid-feeding opening and the liquid-discharging opening.

As the generally elliptic section of the through-hole for the substrate polishing apparatus in the sixth aspect of the invention is disposed to enclose the end faces of the liquid-feeding opening and the liquid-discharging opening in the manner as described above, the area of the through-hole can be minimized to thereby reduce its influence upon polishing characteristics.

In a seventh aspect of the invention, the substrate polishing apparatus is characterized in that the substrate polishing apparatus in any one aspect of the fourth to sixth aspects of the invention is further provided with a forced liquid discharge mechanism to thereby enable forced discharge of liquid from the liquid-discharging opening.

Accordingly, the translucent liquid can be withdrawn reliably from the liquid-discharging opening without using a liquid-feeding tube or a liquid-discharging tube or without an application of a resistance between the polishing member and the surface of the substrate to be polished.

Further, the substrate polishing apparatus in this aspect is able to form an optical path through which the irradiated light and the reflected light can pass, as well as reduce any influence on polishing characteristics, and further avoids the need for a complicated control mechanism, because an amount of the translucent liquid to be fed can be increased by providing an appropriate valve mechanism in combination with the liquid supply system. Thus, in a case where the through-hole is covered by a substrate thereby decreasing an amount of transluscent liquid supplied, or in a case that the amount of the liquid is otherwise reduced, a force for generating a negative pressure in the through-hole can be generated through the through-hole. Moreover, a constant liquid discharge effect can be exerted on the translucent liquid fed to the through-hole, and an influence upon polishing characteristics can be reduced, even in a state where the through-hole is not closed with the substrate to be polished.

EXPLANATION OF REFERENCE NUMERALS

10 is a fixed table; 11, an axis; 12, a polishing member; 14, a table station, 15, a sensor-mounting bracket; 16, a bolt; 17, a sensor main body; 18, a bolt; 20, a substrate support member; 21, a substrate; 22, an axis; 23, a liquid-discharging groove; 30, a monitoring section; 31, a spectrometer; 32, a light source; 33, a personal computer; 34, an electrical signal system; 40, a sensor part; 41, a through-hole; 42, a liquid-feeding opening; 43, an optical fiber for irradiating; 44, an optical fiber for receipt of the reflected light; 45, an optical fiber for use with irradiation and reflection; 46, a liquid-discharging opening; 50, a liquid feed supply-discharge system; 51, a liquid feed supply-discharge system; and 52, a liquid-discharging tube.

DETAILED DESCRIPTION OF THE INVENTION

The present invention will now be described in more detail with reference to the accompanying drawings.

Figure 1:
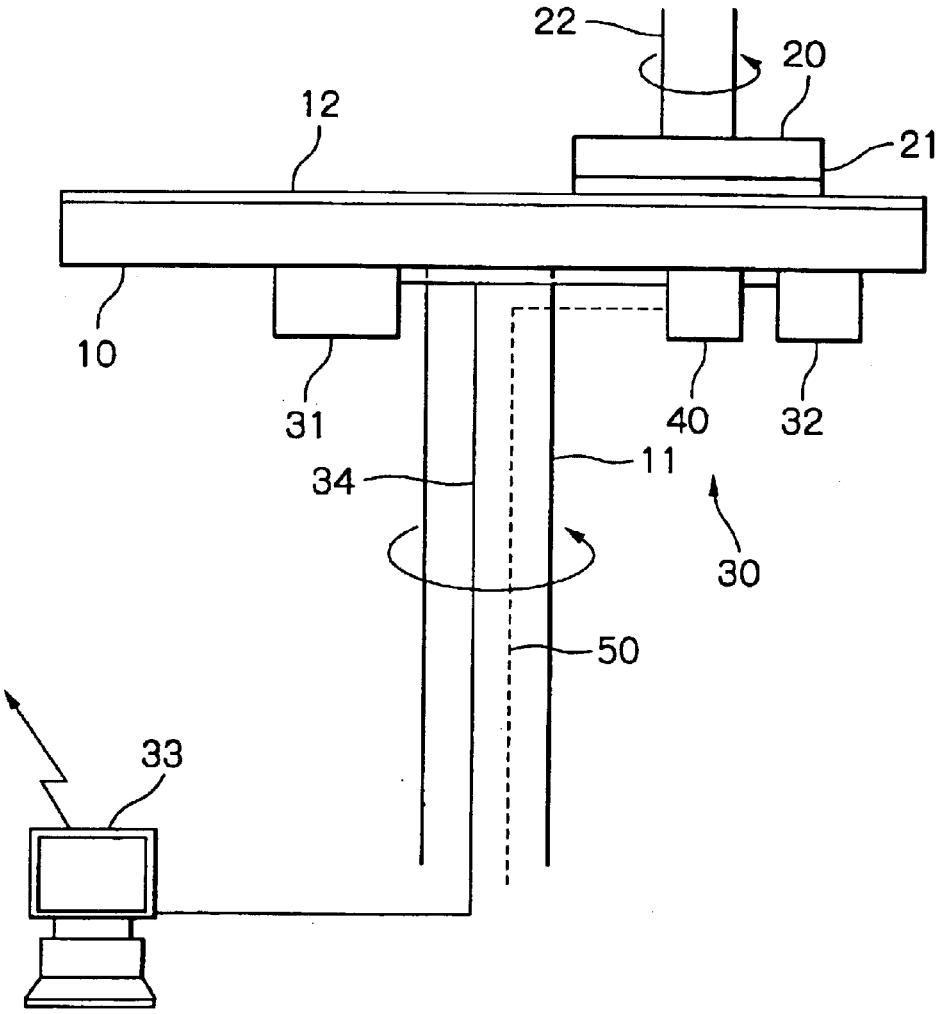
FIG. 1 is an illustration showing one example of a configuration of a substrate polishing apparatus according to the present invention.
Figure 2:
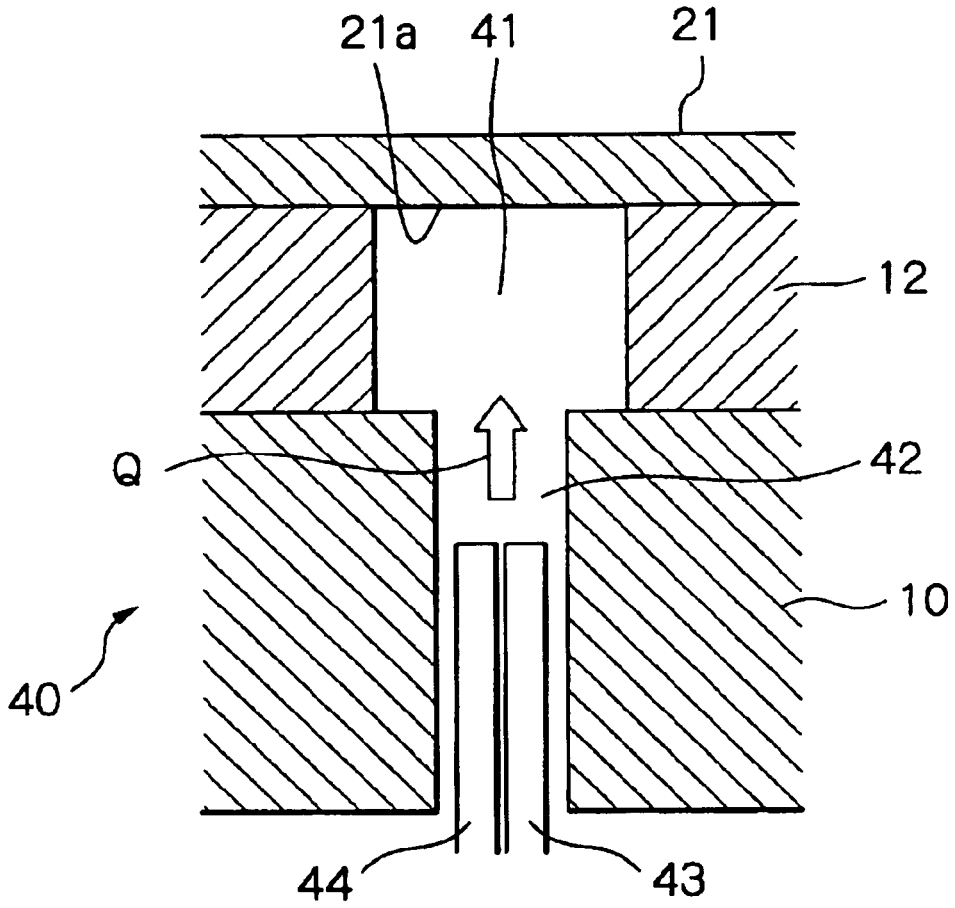
FIG. 2 is a schematic illustration showing one example of a configuration of a sensor part of the substrate polishing apparatus according to the present invention.

FIG. 1 is an illustration showing a configuration of a substrate polishing apparatus according to the present invention, which is equipped with a film-thickness monitoring device for monitoring a film thickness of a thin film on a substrate to be polished. FIG. 2 is an illustration showing an example of a detailed configuration of a sensor part 40.

In FIG. 1, reference numeral 10 denotes a fixed table rotating about an axis 11 as a rotational center, and reference numeral 20 denotes a substrate support member holding a substrate 21 to be polished, such as a sermiconductor wafer or the like, and rotating about an axis 22 as a rotational center. Reference numeral 30 denotes a monitoring section that may be composed of a sensor part 40, a spectrometer 31, a light source 32 and a personal computer 33 for data processing.

The polishing apparatus having the above configuration is arranged such that a polishing member 12, including, but not limited to, fixed polishing grains (e.g., polishing stone, fixed abrasive) or a polishing pad, is put on top of the table 10 so as to polish a surface of the substrate 21 to be polished by means of a relative movement between the polishing member 12 and the substrate 21 to be polished. The sensor part 40 functions to irradiate the surface to be polished of the substrate with light from the light source 32 and receive the light reflected from the substrate surface in a manner as will be described hereinafter in more detail.

The spectrometer 31 measures the spectra of a ray of the reflected light received by the sensor part 40 to yield surface information on the surface of the substrate 21 to be polished. The data-processing personal computer 33 obtains the surface information on the surface from the spectrometer 31 through an electrical signal system 34 and processes the surface information to provide information on the film thickness of the thin film on the surface of the substrate and to transmit the information on the film thickness to a controller of a polishing apparatus (not shown). The controller of the polishing apparatus carries out various controls over the polishing apparatus, including but being not limited to continuation and stop controls of the polishing operations, on the basis of the film-thickness information. In FIG. 1, reference numeral 50 denotes a liquid feed supply-discharge system for feeding and discharging a translucent liquid to and from the sensor part 40.

FIG. 2 is a schematic illustration of an embodiment of the configuration of the sensor part 40 in the first aspect of the invention. As illustrated therein, the polishing member 12, such as the fixed polishing grains or polishing pad, put on top of the table 10 is provided with a through-hole 41, and a liquid-feeding opening 42 for feeding a liquid is provided at the part of the table 10 corresponding to the bottom portion of the through-hole 41. The top portion of the through-hole 41 is closed with the substrate 21 upon polishing the substrate 21 and a translucent liquid Q (light-passing liquid) is fed through the liquid-feeding opening 42 to fill the through-hole 41 with the translucent liquid Q. The translucent liquid Q can be discharged through a gap between the polishing member 12 and the surface 21*a* of the substrate 21 to be polished.

The liquid-feeding opening 42 is disposed in the table 10 in such a manner that its central axis is located at a position perpendicular to a surface 21*a* of the substrate 21 to be polished. In other words, the liquid-feeding opening 42 is disposed such that the translucent liquid Q fed from the substrate 21 flows in a direction roughly perpendicular to the surface 21*a* of the substrate 21. An optical fiber 43 for irradiating the surface 21*a* of the substrate 21 with a light of irradiation and an optical fiber 44 for receipt of the reflected light reflected on the surface 21*a* from the irradiated light are disposed within the liquid-feeding opening 42 in such a manner that their central axes are positioned in parallel to the central axis of the liquid-feeding opening 42.

By the above configuration, the sensor part 40 allows the translucent liquid Q discharged from the liquid-feeding opening 42 to flow in the direction generally perpendicular to the surface 21*a* of the substrate 21, i.e., to form a perpendicular flow with respect to the surface 21*a*, in the manner as described above. The irradiation light from the optical fiber 43 is able to reach the surface 21*a* of the substrate 21 through the flow portion of the translucent liquid Q perpendicular to the surface 21*a*, and the light reflected from the surface 21*a* can reach the optical fiber 44 through the flow portion of the translucent liquid Q perpendicular to the surface 21*a*.

The flow of the translucent liquid Q passing in the direction roughly perpendicular to the surface 21*a* of the substrate 21 acts to wash the surface 21*a* as well as to prevent entry of foreign matter, including polishing grains in the polishing liquid, polished chips of the polishing member 12, polished chips of the substrate 21 to be polished, etc., into a gap between the polishing surface 21*a* and the top surface of the polishing member 12. Therefore, it functions appropriately as a passageway for the irradiation light and the reflected light, and enables reliable and accurate observation of a state of a thin film on the polishing surface 21*a* of the substrate 21 to be performed.

A liquid passageway (although not shown) communicated with the liquid-feeding opening 42 may be provided with an electromagnetic valve 47 that may be controlled to stop or regulate a supply of the translucent liquid Q when the through-hole 41 is not covered by the substrate 21 to be polished, thereby lessening any influence on polishing characteristics. Further, the sensor part 40 having the above configuration is able to work effectively in a situation where the through-hole 41 is covered with a substrate to be polished or where the table 10 is arranged so as to define a planar movement, allowing each point of the table to draw a circular locus having an identical radius without rotating the table about one axis as a rotational center.

Figure 3:
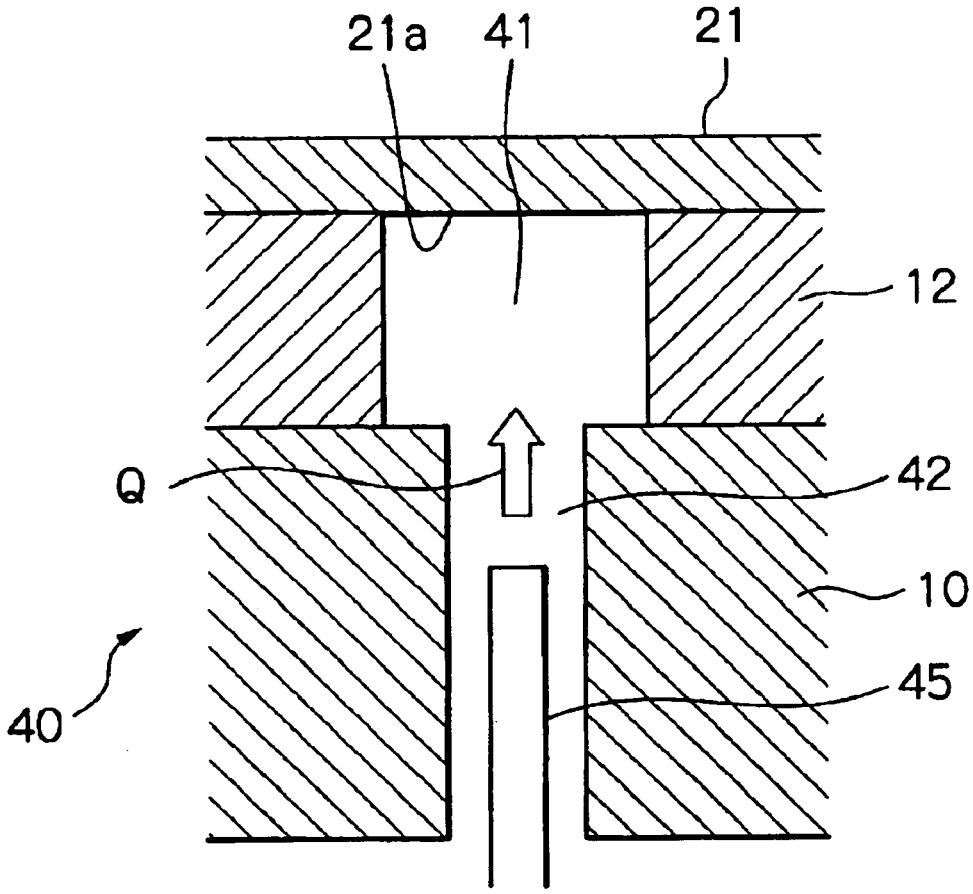
FIG. 3 is a schematic illustration showing another example of a configuration of a sensor part of the substrate polishing apparatus according to the present invention.

FIG. 3 is a brief illustration of another embodiment of the construction of the sensor part 40 according to the first aspect of the invention. As illustrated therein, the sensor part 40 of FIG. 3 is different from the sensor part 40 of FIG. 2 in that it uses only one optical fiber 45 for irradiation and reflection of light in place of respective optical fibers for irradiation and reception of irradiated light. The other elements, however, are constructed in substantially the same manner as in the case of the sensor part 40 of FIG. 2. Using this construction, the sensor part 40 of this aspect of the invention can demonstrate substantially the same action and effects as that of FIG. 2.

Figure 4:
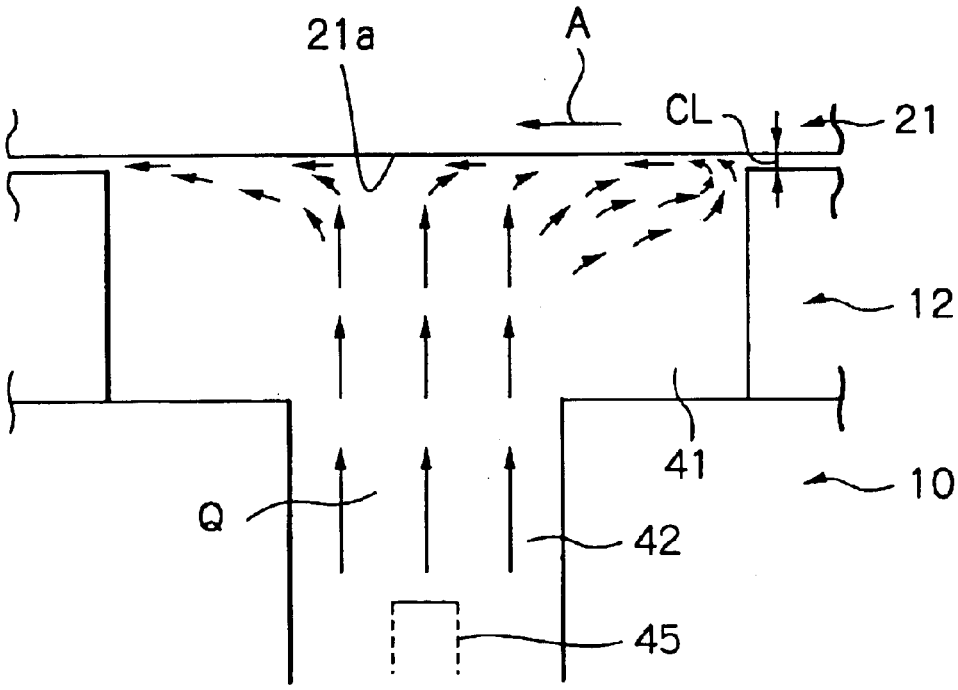
FIG. 4 is a diagram showing a flow state of the translucent liquid within the through-hole of the sensor part as illustrated in FIGS. 2 and 3, in which FIG. 4(*a*) illustrates a side flow of the translucent liquid within the through-hole and FIG. 4(*b*) illustrates a plane flow thereof above it.
Figure 4:
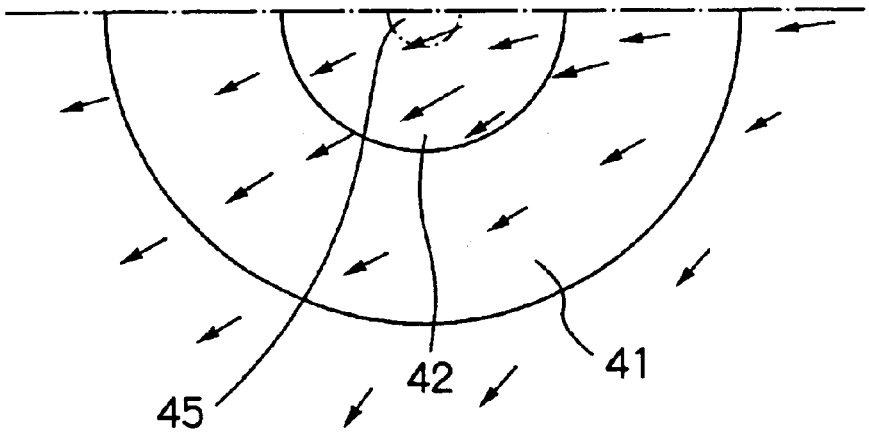

FIG. 4 illustrates the state of a flow of the translucent liquid at the sensor part 40 as illustrated in FIGS. 2 and 3. As illustrated in this figure, the flow state of the translucent liquid Q is drawn on the basis of the results of numerical analysis of the flow which has been made on the assumption that a flow of the translucent liquid Q occurs, together with a movement of the surface 21*a* of the substrate 21, at the portion nearest to the surface 21*a*. This is true of FIGS. 6, 9, 10, 12, and 13, each of which illustrates the state of each flow of the translucent liquid at other portions.

FIG. 4(*a*) illustrates a side flow of the translucent liquid at the side of the through-hole 41, and FIG. 4(*b*) illustrates a plane flow thereof at the top of the through-hole 41 (at a position spaced apart by approximately 0.03 mm above the polishing surface). Here, it is calculated that there is a clearance (CL) of 0.1 mm between the surface of the substrate 21 and the top surface of the polishing member 12. The side flow of the translucent liquid Q at the side of the through-hole 41 constitutes a flow of the translucent liquid Q discharged from the liquid-feeding opening 42 flowing in the direction perpendicular to the polishing surface 21*a* of the substrate 21, as indicated by the arrows in FIG. 4(*a*).

On the other hand, the plane flow of the translucent liquid Q at the top of the through-hole 41 passes generally in the direction of movement of the polishing substrate 21 (opposite to the direction of movement of the table 10), as indicated by the arrows in FIG. 4(*b*). Although a portion of the plane flow passes above the tip portion of the optical fiber 45, such a flow is not sufficiently large to cause any interference with the formation of an optical path because the flow occurs only at a limited location close to the surface 21*a* of the substrate 21 to be polished. In FIG. 4, the arrow A indicates the direction of movement of the substrate 21.

Figure 5:
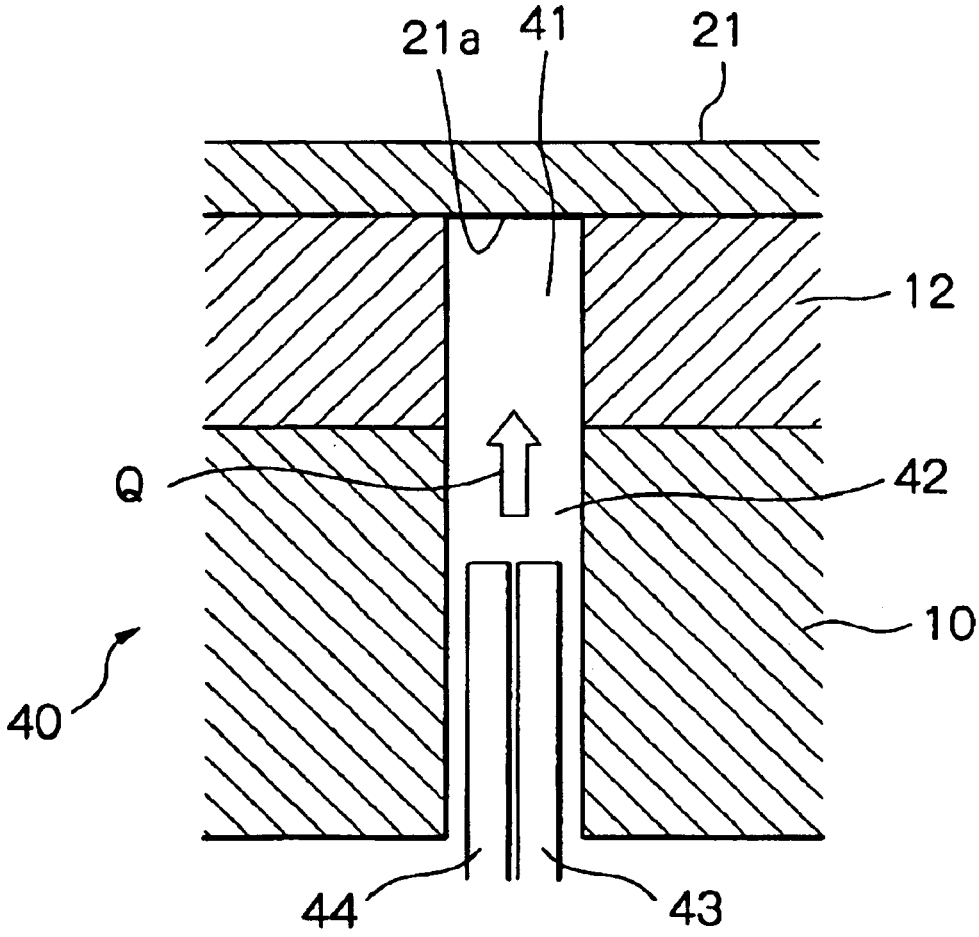
FIG. 5 is a schematic illustration showing another example of the configuration of a sensor part of the substrate polishing apparatus according to the present invention.

FIG. 5 is a schematic illustration of another embodiment of the sensor part 40 in the second aspect of the invention. The sensor part 40 of FIG. 5 is different from the sensor part 40 of FIG. 4 in that the sensor part 40 of FIG. 5 comprises the through-hole 41 and the liquid-feeding opening 42, in which the through-hole 41 has a section extending in a direction perpendicular to the flow of the translucent liquid Q, and is equal in size to the liquid-feeding opening 42, and is communicated with the latter. Further, the optical fiber 43 for the irradiating light and the optical fiber 44 for the reflected light are disposed within the through-hole 41 at the sensor part 40 of FIG. 5 such that the central lines of the optical fiber 43 and the optical fiber 44 extend in parallel to the central line of the liquid-feeding opening 42 in substantially the same manner as in FIG. 2.

As indicated in FIG. 5, the through-hole 41 is disposed so as to have a section positioned perpendicular to the flow of the translucent liquid Q, and is substantially equal in size to the liquid-feeding opening 42; and the through-hole 41 is communicated with the liquid-feeding opening 42 in the manner as described above, so that the translucent liquid Q fed through the liquid-feeding opening 42 into the through-hole 41 flows in the direction perpendicular to the surface 21*a* of the substrate 21 and flows up to the surface 21*a*. In other words, the translucent liquid Q appropriately constitutes an optical path through which the irradiated light and the reflected light can pass, even in a case that the liquid exists only in a small amount. Therefore, any influence of the translucent liquid Q upon polishing of the substrate with the polishing apparatus can be minimized.

For the sensor part 40 of FIG. 5, it is possible to use only one optical fiber 45 for the irradiated light and for the reflected light, as opposed to using respective fibers, as indicated in FIG. 3.

Figure 6:
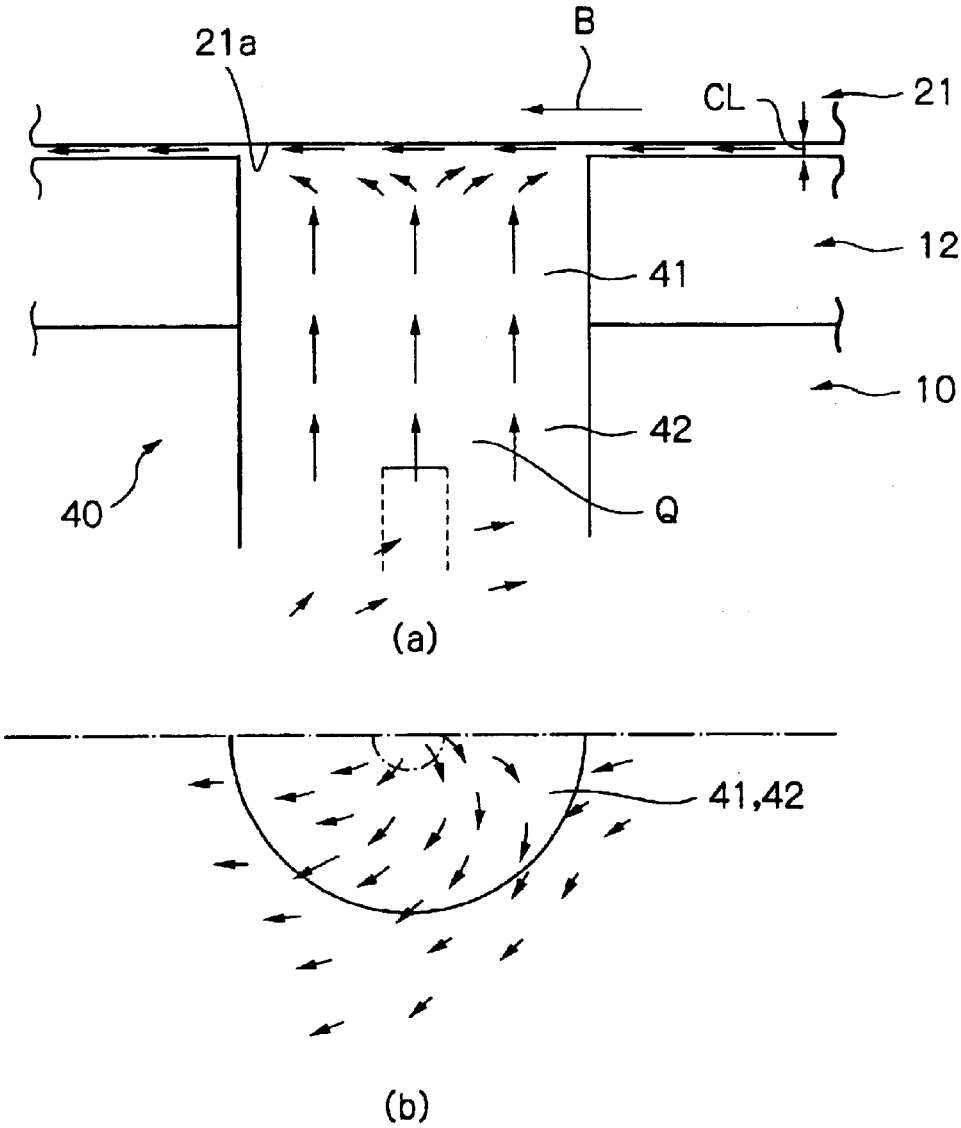
FIG. 6 is a diagram showing a flow state of the translucent liquid within the through-hole of the sensor part as illustrated in FIG. 5, in which FIG. 6(*a*) illustrates a side flow of the translucent liquid within the through-hole and FIG. 6(*b*) illustrates a plane flow thereof above it.

FIG. 6 is a schematic illustration indicating a flow state of the translucent liquid Q in the through-hole 41 of the sensor part 40 in the embodiment of FIG. 5. FIG. 6(*a*) illustrates a side flow of the translucent liquid Q within the through-hole 41 and FIG. 6(*b*) illustrates a plane flow of the translucent liquid Q at the top portion of the through-hole 41 (at the position apart by about 0.03 mm from the surface in a manner similar to the case of FIG. 4). It is computationally assumed that there is a clearance (CL) of 0.1 mm between the surface of the substrate 21 and the top surface of the polishing member 12. The side flow of the translucent liquid Q within the through-hole 41 is constituted as a flow in which the translucent liquid Q fed through the liquid-feeding opening 42 flows in the direction perpendicular to the substrate 21 to be polished, as indicated by the arrows in FIG. 6(*a*).

As indicated by the arrows in FIG. 6(*b*), the plane flow of the translucent liquid Q on top of the through-hole 41 flows toward outside from the inside of the through-hole 41, so that there is no flow component that flows toward the position of the optical fiber. Therefore, as compared with the case illustrated in FIG. 4, it is not likely that the polishing liquid will flow in a reverse direction into the through-hole 41 through a gap between the surface 21*a* of the substrate 21 and the top of the polishing member 12. In FIG. 6(*a*), the arrow B indicates a direction of movement of the substrate 21 to be polished.

Figure 7:
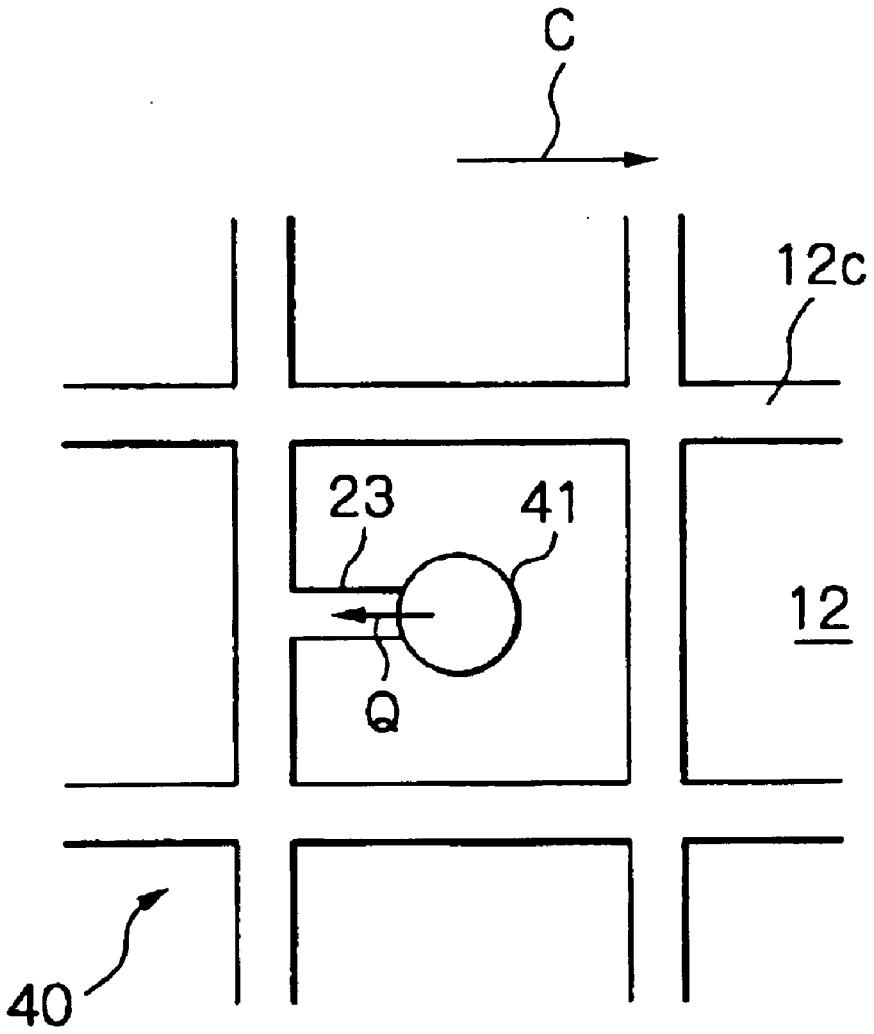
FIG. 7 is an illustration showing an example of a plane configuration of the through-hole of the sensor part for the substrate polishing apparatus according to the present invention.

FIG. 7 indicates an embodiment of a plane disposition of the through-hole 41 of the sensor part 40 in the third aspect of the invention. In this embodiment, the polishing member 12 is provided on the surface with a liquid-discharging groove 23 for discharging the translucent liquid from the inner side of the through-hole 41 rearward in the direction of movement of the table 10, as indicated by the arrow C of FIG. 7. The disposition of the liquid-discharging groove 23 can ensure easy discharge of the translucent liquid Q that may be filled in the closed space of the through-hole 41 without the provision of a special system. This embodiment is effective to transfer the substrate in the generally identical direction relative to the through-hole, including rotating the table about one axis, or the like. In particular, the liquid-discharging groove can be provided easily in the case where a groove in the form of a lattice is formed on the surface of the polishing member.

FIG. B is a schematic illustration showing another embodiment of the sensor part 40 in the fourth aspect of the invention. In this embodiment, the sensor part 40 is provided with a liquid-discharging opening 46 for discharging the translucent liquid Q filled in the through-hole 41 behind the liquid-feeding opening 42 in the direction of movement of the table 10 (in the direction as indicated by the arrow D) and has an opening at the edge face of the through-hole 41 opposite to the substrate 21.

The optical fiber 43 for irradiation of light and the optical fiber 44 for reflection of irradiated light are disposed in the liquid-feeding opening 42 in such a manner that each of their central lines is positioned in parallel to the central line of the liquid-feeding opening 42 in substantially the same manner as in the case of FIG. 2. It can also be noted herein that the optical fiber 43 for irradiation of light and the optical fiber 44 for reflection of irradiated light may be replaced with a single optical fiber 45 for both of irradiation and reflection in a similar manner as indicated in FIG. 3.

As the liquid-discharging opening 46 is disposed in the manner as described above, the translucent liquid Q filled in the through-hole 41 can be withdrawn easily into a gap between the substrate 21 and the polishing member 12, and further the translucent liquid Q can be withdrawn without dilution of the polishing liquid such as slurry and so on present therein.

Figure 8:
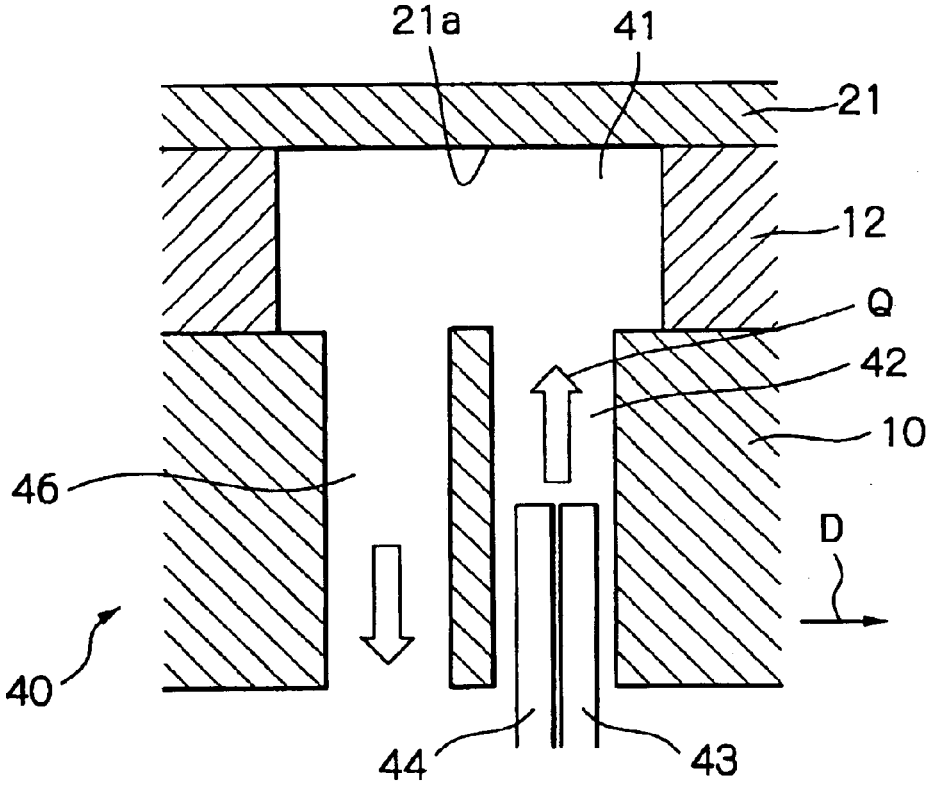
FIG. 8 is a schematic diagram showing another example of the configuration of a sensor part of the substrate polishing apparatus according to the present invention.
Figure 9:
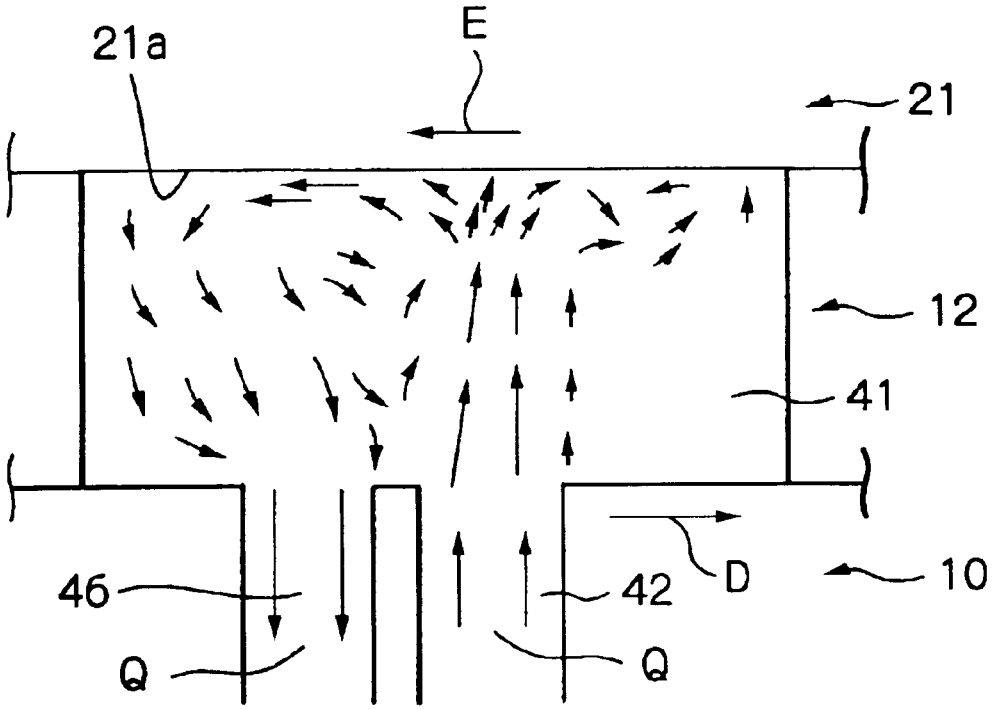
FIG. 9 is an illustration showing a side flow of the translucent liquid at the side of the through-hole in the sensor part as illustrated in FIG. 8.
Figure 10:
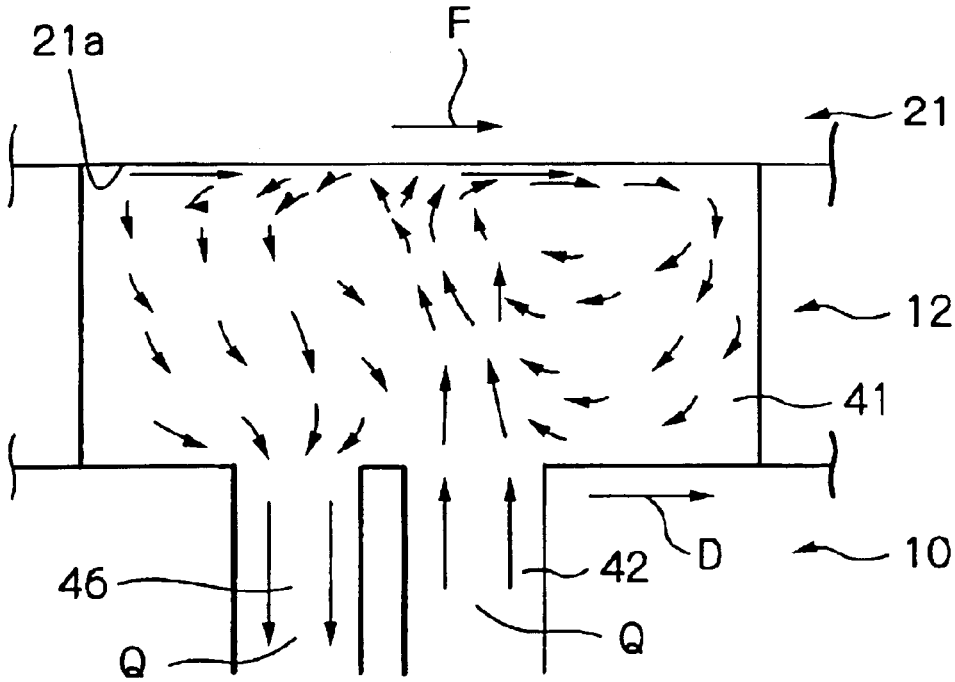
FIG. 10 is an illustration showing a side flow of the translucent liquid at the side of the through-hole in the sensor part as illustrated in FIG. 8 (as a comparative example).

FIGS. 9 and 10 illustrate each a side flow of the translucent liquid Q travelling inside the through-hole 41 of the sensor part 40 of FIG. 8. In FIGS. 9 and 10, the arrow D indicates the direction of movement of the table and the arrows E and F indicate each direction of movement of the substrate 21 to be polished.

As the liquid-discharging opening 46 is provided behind the liquid-feeding opening 42 in the direction of movement of the table 10 (as indicated by the arrow D) in the manner as shown in FIG. 9, the translucent liquid Q fed into the through-hole 41 from the liquid-feeding opening 42 collides against the surface 21*a* of the substrate 21 and then is smoothly withdrawn through the liquid-discharging opening 46. Therefore, the translucent liquid Q fed into the through-hole 41 from the liquid-feeding opening 42 can form a flow perpendicular to the surface 21*a* of the substrate 21.

However, if the liquid-feeding opening 42 and the liquid-discharging opening 46 are disposed in the direction of movement of the table 10 (as indicated by the arrow D therein) in this order as shown in FIG. 10, a majority of the flow of the translucent liquid Q struck against the surface 21*a* of the substrate 21 is returned upon colliding against the side wall of the through-hole 41, with the effect that turbulence may be generated in the flow of the translucent liquid Q in the through-hole 41. The configuration of this embodiment is also effective, however, when the substrate to be polished can be disposed so as to move in generally the same direction relative to the through-hole, for example, by rotating a table, such as a turntable, about one axis.

Figure 11:
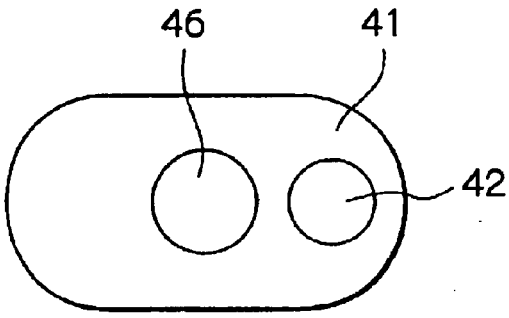
FIG. 11 is a schematic illustration showing another example of the configuration of a sensor part of the substrate polishing apparatus according to the present invention, in which FIG. 11(*a*) is a plan view and FIG. 11(*b*) is a side view in section.
Figure 11:
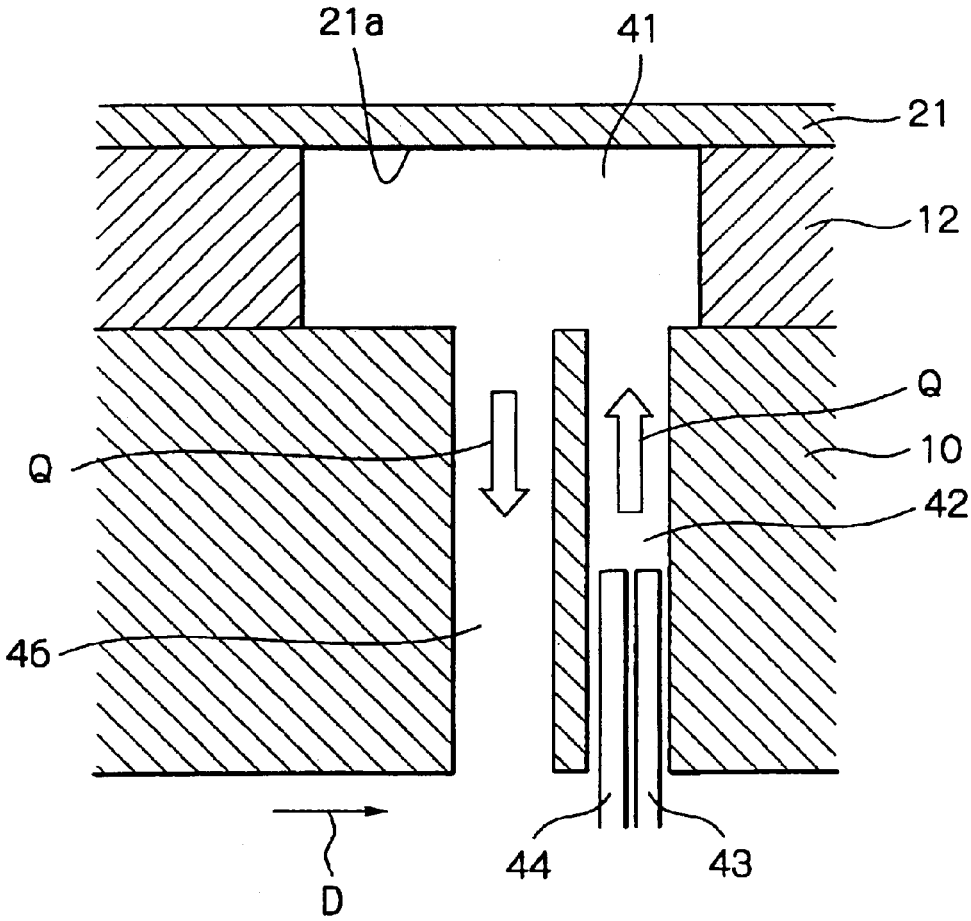

FIG. 11 is a schematic illustration of another embodiment of the sensor part 40, as the fifth and sixth aspects of the invention, in which FIG. 11(*a*) is a plan view and FIG. 11(*b*) is a side view in section. As shown therein, the liquid-feeding opening 42 and the liquid-discharging opening 46 are disposed before the middle point of the line segment connecting the central point of the liquid-feeding opening 42 and the central point of the liquid-discharging opening 46 in the direction of movement of the table 10, as indicated by the arrow D therein. More specifically, the liquid-feeding opening 42 and the liquid-discharging opening 46 are disposed in this order, that is, the liquid-feeding opening 42 is located before the liquid-discharging opening 46, in the direction of movement of the table 10.

Further, the through-hole 41 has a lateral section in a generally elliptic form so as for an outer circumference of the bottom side face thereof to enclose the upper edges of the liquid-feeding opening 42 and the liquid-discharging opening 46. This arrangement of the through-hole 41 can form a flow of the translucent liquid Q fed into the through-hole 41 from the liquid-feeding opening 42 as a flow travelling perpendicularly to the surface 21*a* of the substrate 21 to be polished. Moreover, the formation of the through-hole 41 in a generally elliptic section minimizes the area of the through-hole 41, thereby reducing any influence on polishing characteristics.

In this embodiment, too, the optical fiber 43 for irradiation of light and the optical fiber 44 for reflection of light are disposed in the liquid-feeding opening 42 such that their central lines extend in parallel to the central line of the liquid-feeding opening 42 in substantially the same manner as in the case of FIG. 2. It is to be noted herein, however, that the optical fibers 43 and 44 can be replaced with a single optical fiber 45 for use with both irradiation and reflection in the manner shown in FIG. 3.

Figure 12:
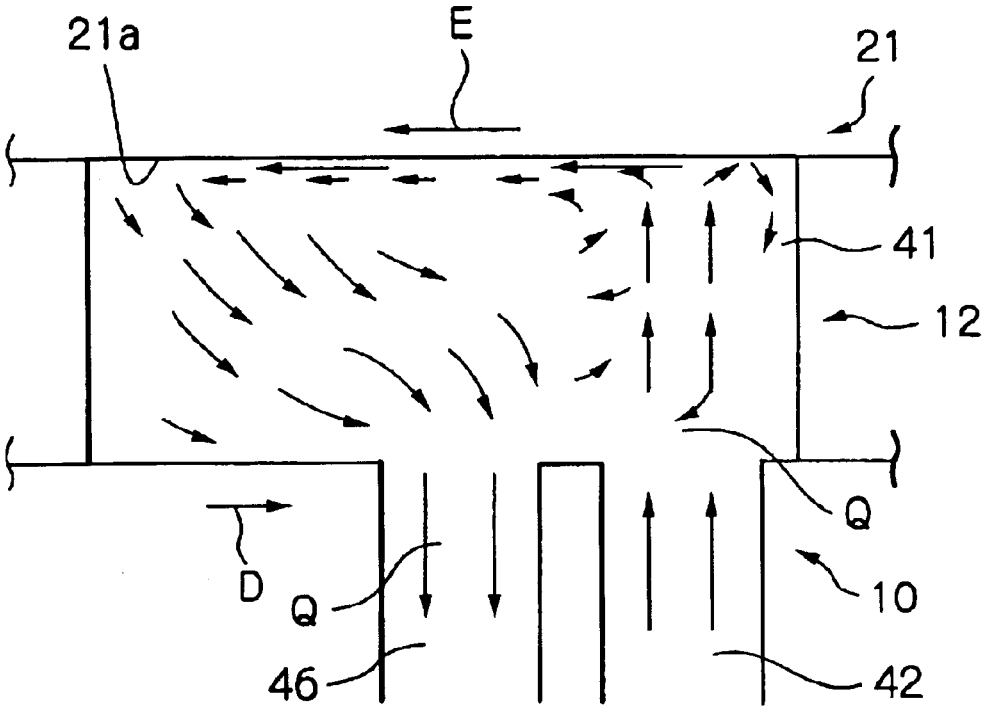
FIG. 12 is an illustration showing a flow at the side of the through-hole in the sensor part as illustrated in FIG. 11.

FIG. 12 is a schematic illustration showing a side flow of the translucent liquid Q in the through-hole 41 in the case where the liquid-feeding opening 42 and the liquid-discharging opening 46 are disposed in such a way that the middle point of the line segment connecting the center of the liquid-feeding opening 42 and the center of the liquid-discharging opening 46 is located before the central point of the through-hole 41 in the direction of movement of the table 10 (as indicated by the arrow D).

Figure 13:
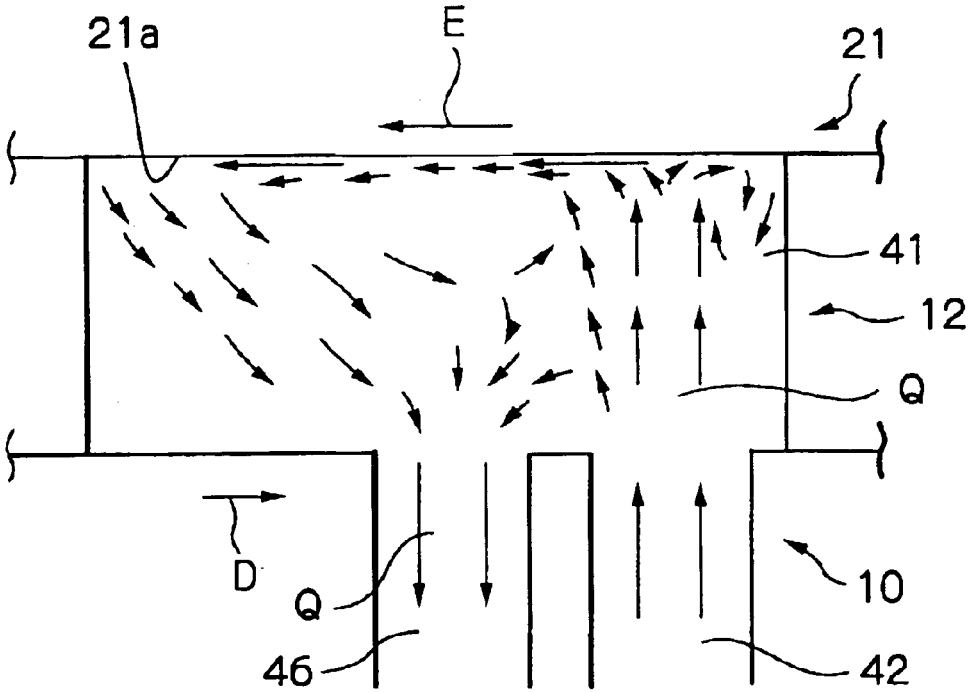
FIG. 13 is an illustration showing a side flow of the translucent liquid at the side of the through-hole in the sensor part as illustrated in FIG. 11.

Although the through-hole 41 has a circular section in each of the embodiments, as indicated in the previous figures and FIG. 12, FIG. 13 further illustrates a side flow of the translucent liquid Q in the through-hole 41 in the case where the through-hole 41 is formed in a generally elliptic section so that the outer circumference of the bottom edge encloses the side faces of the liquid-feeding opening 42 and the liquid-discharging opening 46.

When the liquid-feeding opening 42 and the liquid-discharging opening 46 are disposed in the direction of movement of the table 10 (as indicated by the arrow D) with respect to the through-hole, as shown in FIGS. 12 and 13, the translucent liquid Q existing in the through-hole 41 at a position rearward in the direction of movement of the table 10 can be withdrawn in a smoother way than in the case of FIG. 9, so that the translucent liquid Q fed into the through-hole 41 from the liquid-feeding opening 42 can flow in the direction perpendicular to the surface 21*a* of the substrate 21 and form a perpendicular flow with respect to the surface 21*a*.

The sensor part as shown in each of FIGS. 8 and 11 may be provided with a forced liquid discharge mechanism, although not shown in the drawings, for performing a forced discharge of the translucent liquid from the liquid-discharging opening 46. The forced liquid discharge mechanism can ensure reliable discharge of the translucent liquid Q from the liquid-discharging opening 46 without use of a liquid-feeding tube communicating with the liquid-feeding opening 42 or a liquid-discharging tube communicating with the liquid-discharging opening 46 or without an application of resistance between the surface 21*a* of the substrate 21 and the polishing member 12.

Further, a supply amount of the translucent liquid Q can be increased by combining a liquid supply system with a valve mechanism having an appropriate pressure adjustment mechanism because the force may act to generate a negative pressure within the through-hole 41 in a case where the through-hole 41 is disposed and brought into a closed state, even if the supply amount of the translucent liquid Q is reduced in such a state where the through-hole 41 is not covered by the substrate 21 to be polished.

Therefore, in this embodiment of the present invention an optical path is formed which allows passage of irradiated light of and reflected irradiated light, as well as reducing any influence on polishing characteristics, without the need for a complex control mechanism. Moreover, this embodiment allows a constant effect to be attained in the discharge of the translucent liquid Q fed into the through-hole 41 to be expected in a state where the through-hole 41 is not closed with the substrate 21 and, at the same time, is able to reduce any influence on polishing characteristics.

Figure 14:
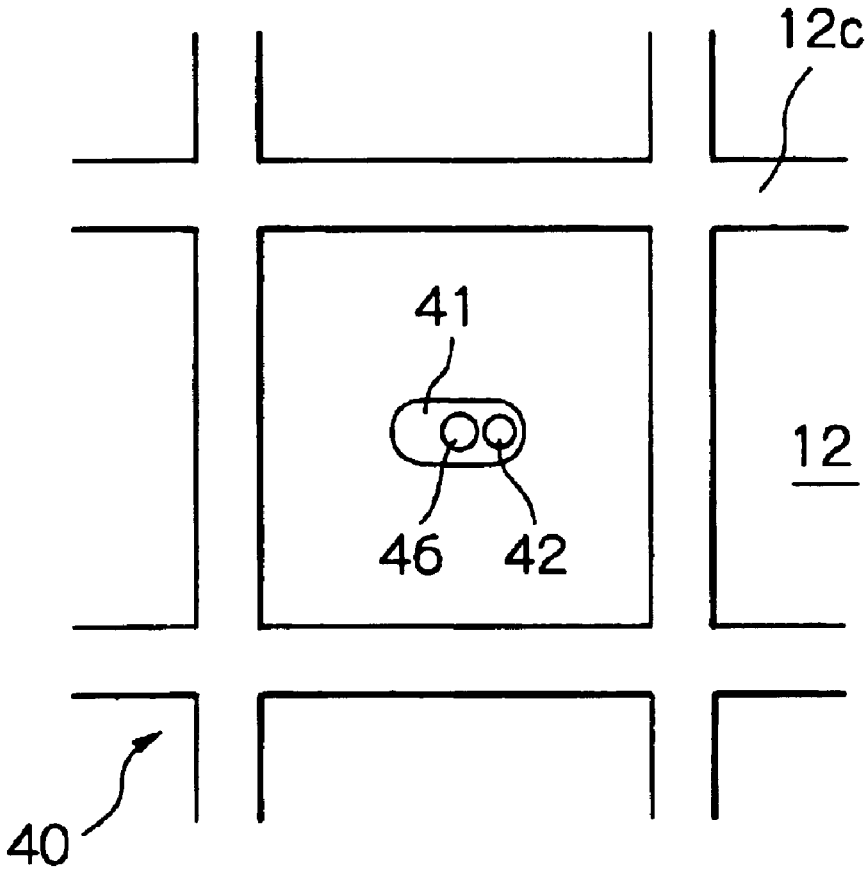
FIG. 14 is an illustration showing an example of a plane configuration of the through-hole of the sensor part for the substrate polishing apparatus according to the present invention.

FIG. 14 is a plan view showing an embodiment of a plane configuration of the through-hole 41 of the sensor part 40. As indicated therein, the through-hole 41 is disposed so as to cause no interference with a groove 12*c* formed on the surface of the polishing member 12. The provision of the groove 12*c* in this way can ensure a close engagement between the substrate 21 to be polished and the polishing member 12 and improve closing properties within the through-hole 41, thereby preventing particles, including material grains of the polishing liquid, polished chips of the polishing member and the substrate, etc., into the through-hole 41 as well as preventing leakage of the translucent liquid Q into a gap between the substrate 21 to be polished and the polishing member 12.

Figure 15:
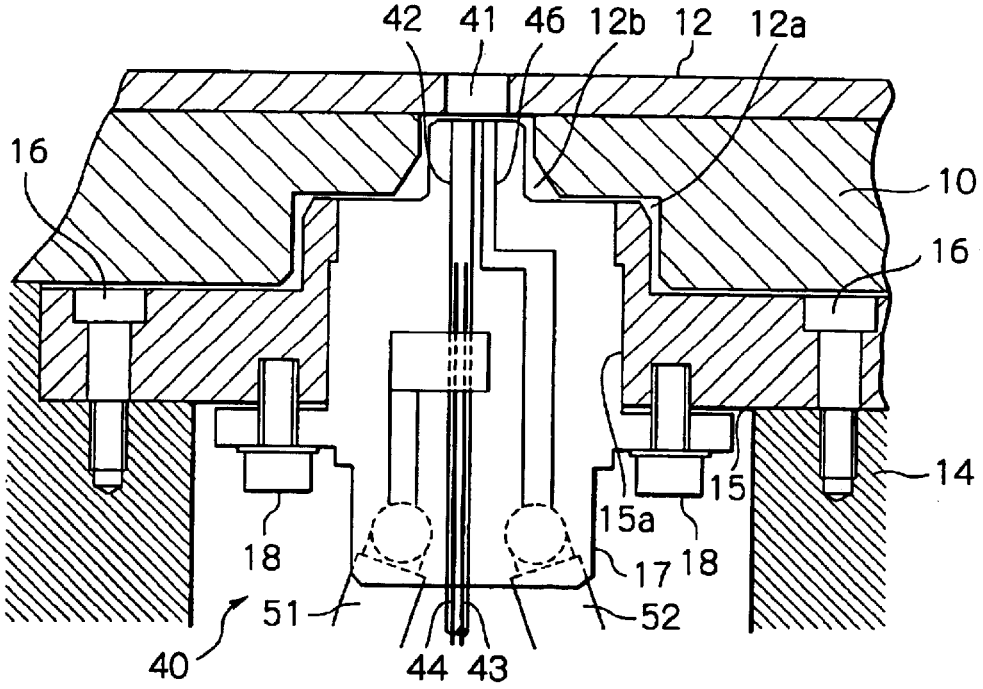
FIG. 15 is an illustration showing an example of a specific configuration of the sensor part for the substrate polishing apparatus according to the present invention.

FIG. 15 illustrates a specific embodiment of the sensor part 40. As indicated therein, the table 10 is fixed on a table station 14 and provided underneath with a sensor-mounting depression 12*a* for mounting a sensor. An edge portion of a sensor-mounting bracket 15 is inserted into the sensor-mounting depression 12*a* and a base portion of the sensor-mounting bracket 15 is mounted on the table station 14 through bolts 16.

At a central portion of the sensor-mounting depression 12*a* is formed a hole 12*b* into which a tip portion of a sensor main body 17 of the sensor part, with the liquid-feeding opening 42 and the liquid-discharging opening 46 formed therein, is inserted. Further, the sensor-mounting bracket 15 is provided with an opening 15*a* for receiving the sensor main body 17. By the above configuration, the sensor main body 17 is inserted into the opening 15*a* of the sensor-mounting bracket 15 and the base portion of the sensor main body 17 is in turn fixed to the sensor-mounting bracket 15 through bolts 18.

Moreover, the polishing member 12, such as a polishing stone (fixed polishing grains), a polishing pad or the like, put on the top surface of the table 10, is provided with the through-hole 41 having an opening so as to communicate with the top ends of the liquid-feeding opening 42 and the liquid-discharging opening 46 formed in the sensor main body 17. In addition, the liquid-feeding opening 42 and the liquid-discharging opening 46 formed in the sensor main body 17 are connected to a liquid-feeding tube 51 and a liquid-discharging tube 52, respectively.

In the above embodiments, the present invention has been described in detail by taking as an example the polishing apparatus having a configuration arranged in such a manner that the surface of the substrate 21 to be polished is polished by a relative movement between the polishing member 12 and the substrate 21 in such a state that the substrate 21 supported by the substrate support member 20 is pressed onto the polishing member 12 put on the top surface of the table 10 disposed underneath.

It is to be noted, however, that the present invention should not be interpreted in any respect as being limited to the above embodiments, and it is to be understood that any number of modifications of such a substrate polishing apparatus are conceivable. Such modifications substrate polish may include, but are not limited to, a configuration in which the table may be disposed above and the substrate support member may be disposed underneath.

Effects Of The Invention

The substrate polishing apparatus according to the embodiments of each aspect of the invention as described above, and including any appropriate conceiveable modifications, can exhibit remarkable effects as described below.

The substrate polishing apparatus according to the embodiment in the first aspect of the invention is constructed in such a manner that the liquid-feeding opening for feeding the translucent liquid is disposed so as for the translucent liquid fed into the through-holethrough-hole to flow in the direction roughly perpendicularly to the polishing surface of the substrate to be polished, i.e., to form a perpendicular flow with respect to the polishing surface thereof, and to fill in the through-holethrough-hole and, further, that the polishing surface of the substrate is irradiated with a light of irradiation through a flow portion of the translucent liquid travelling in the roughly perpendicular direction and receives the light of reflection.

Therefore, a state of a film thickness on the polishing surface of the substrate can be observed with high accuracy and stability without causing any particles including polished chips of the polishing member and the substrate, etc., to be contaminated with the translucent liquid and to penetrate into a gap between the polishing member and the substrate, and without causing any interference with such particles.

The present invention in the second aspect can form an optical path from a small amount of the translucent liquid, which is appropriate for allowing the light of irradiation and the light of reflection to pass therethrough, because the through-hole has the same section extending in the direction perpendicular to the flow of the translucent liquid as the liquid-feeding opening and the through-hole is communicated with the liquid-feeding opening. Therefore, the translucent liquid fed from the liquid-feeding opening can flow in the direction perpendicular to the polishing surface of the substrate to be polished up to the polishing surface thereof.

In the third aspect of the invention, the translucent liquid filled in the closed space within the through-hole can be readily withdrawn without using any special system because the polishing member is provided on top thereof with the liquid-discharging groove rearward from the inner side face of the through-hole in the direction of movement of the table.

For the substrate polishing apparatus according to the embodiment in the fourth aspect of invention, the liquid-discharging opening is disposed behind the liquid-feeding opening in the direction of movement of the table and it has an opening at the edge of the through-hole opposite to the substrate to be polished. Therefore, the translucent liquid in the through-hole can be withdrawn into a gap between the substrate and the polishing member without dilution of the polishing liquid present therein. Moreover, the liquid-discharging opening is disposed in the position behind the liquid-feeding opening in the direction of movement of the table in the manner as described above, so that the translucent liquid fed into the through-hole from the liquid-feeding opening can flow in the direction roughly perpendicular to the polishing surface of the substrate to be polished, i.e., form a perpendicular flow with respect to the polishing surface thereof.

The present invention according to the embodiment in the fifth aspect allows the translucent liquid fed into the through-hole from the liquid-feeding opening to flow in the direction perpendicular to the polishing surface of the substrate to be polished, i.e., to form a perpendicular flow with respect to the polishing surface thereof, because the liquid-feeding opening and the liquid-discharging opening are disposed at the forward side of the through-hole in the direction of movement of the table.

The substrate polishing apparatus according to the embodiment in the sixth aspect of the invention can reduce an influence upon polishing characteristics because the area of the through-hole can be minimized by forming the section of the through-hole in a generally elliptic shape so as for the outer circumference of the side face thereof to enclose the edge faces of the liquid-feeding opening and the liquid-discharging opening.

In the seventh aspect of the invention, the translucent liquid can be withdrawn from the liquid-discharging opening with certainty without using the liquid-feeding tube or the liquid-discharging tube or without applying a resistance between the polishing surface of the substrate and the polishing member because the translucent liquid can be withdrawn in a forced way by means of the forced liquid discharge mechanism.

Further, this embodiment of the present invention can form an optical path appropriate for allowing a passage of the light of irradiation and the light of reflection without the provision of any complex control mechanism, while decreasing an impact on polishing characteristics, because a supply amount of the translucent liquid can be increased by combination of the liquid supply system with an appropriate valve mechanism due to the action of a force for making the pressure within the through-hole a negative pressure when the through-hole is blocked with the substrate into a closed state, even in the case where the supply amount of the translucent liquid is decreased in a state where the through-hole is not closed with the substrate to be polished. Moreover, the embodiment of the present invention can perform a constant liquid discharge effect of discharging the translucent liquid fed into the through-hole and decrease an influence upon polishing characteristics.

What is claimed is:

1. A substrate polishing apparatus for polishing a surface of a substrate by a relative movement between the substrate and a polishing member, comprising: a table, the polishing member fixed on a surface of the table, a substrate support member for pressing the substrate onto the polishing member, an optical system for irradiating a surface of the substrate with a light of irradiation through a through-hole disposed in the polishing member and for receiving a reflected light reflected from the surface of the substrate, and a film-thickness monitoring device for monitoring a status of polishing by the optical system;

wherein a valve to regulate a supply of a liquid is provided in a liquid passageway communicated with the through-hole so that the liquid, to be discharged from a liquid-feeding opening, flows in a direction generally perpendicular to a surface of the substrate, and the optical system comprises an optical fiber for irradiating the surface of the substrate with light in such a manner that the light is able to reach the surface of the substrate through a portion of the liquid flowing perpendicular to the surface.

2. The substrate polishing apparatus according to claim 1, wherein the valve is controlled to regulate a supply of the liquid when the through-hole is not covered by the substrate.

3. The substrate polishing apparatus according to claim 1, wherein the table is rotated about one axis.

4. The substrate polishing apparatus according to claim 1, wherein each point of the table draws a circular locus having an identical radius.

5. The substrate polishing apparatus of claim 1, wherein said optical fiber has a central line parallel to a central line of said liquid feeding opening such that the light from said optical fiber will be perpendicular to the surface of the substrate.

6. A substrate polishing apparatus for polishing a surface of a substrate by relative movement between the substrate and a polishing member, comprising:

a table;

a polishing member fixed on a surface of said table, said polishing member having a through hole therein;

a substrate support member for pressing a surface of a substrate onto said polishing member;

a film thickness monitoring device for monitoring a status of polishing the substrate, said film thickness monitoring device having an optical system for irradiating the surface of the substrate, when pressed against said polishing member, with light through said through hole in said polishing member and for receiving light reflected from the surface of the substrate; and a liquid passageway communicating with said through hole, said liquid passageway having a valve to regulate a supply of liquid and a liquid feeding opening and being arranged such that liquid supplied from said liquid passageway to said through hole through said liquid feeding opening will flow in a direction generally perpendicular to the surface of the substrate when the surface of the substrate is pressed against said polishing member;

wherein said optical system comprises an optical fiber for irradiating the surface of the substrate with the light such that the light is able to reach the surface of the substrate through a portion of the liquid that is flowing generally perpendicular to the surface of the substrate.

7. The substrate polishing apparatus of claim 6, wherein said valve is operable to regulate the supply of liquid when said through hole is not covered by the substrate.

8. The substrate polishing apparatus of claim 6, wherein said table is arranged so as to rotate about one axis.

9. The substrate polishing apparatus of claim 6, wherein said table is arranged so that, upon rotation of said table, each point of the table draws a circular locus having an identical radius.

10. The substrate polishing apparatus of claim 6, wherein said optical fiber has a central line parallel to a central line of said liquid feeding opening such that the light from said optical fiber will be perpendicular to the surface of the substrate.

* * * * *